US005782686A

United States Patent [19]

Geib et al.

[11] Patent Number: 5,782,686

[45] Date of Patent: Jul. 21, 1998

[54] DISC COIN SORTER WITH SLOTTED EXIT CHANNELS

[75] Inventors: Joseph J. Geib, Mt. Prospect; Scott D. Casanova, Roselle; Douglas U. Mennie, Barrington, all of Ill.

[73] Assignee: Cummins-Allison Corp., Mt. Prospect, Ill.

[21] Appl. No.: 566,928

[22] Filed: Dec. 4, 1995

[51] Int. Cl.[6] ..... G07D 3/16

[52] U.S. Cl. ..... 453/10; 453/32

[58] Field of Search ..... 453/6, 10, 5, 7, 453/9, 11, 12, 14, 32; 194/344, 329

[56] References Cited

U.S. PATENT DOCUMENTS

| | | | |
|---|---|---|---|
| 3,559,789 | 2/1971 | Hastie et al. . | |
| 3,672,481 | 6/1972 | Hastie et al. . | |
| 3,788,440 | 1/1974 | Propice et al. . | |
| 3,795,252 | 3/1974 | Black . | |
| 3,910,394 | 10/1975 | Fujita . | |
| 3,921,003 | 11/1975 | Greene | 250/557 |
| 3,978,962 | 9/1976 | Gregory, Jr. . | |
| 3,980,168 | 9/1976 | Knight et al. . | |
| 4,111,216 | 9/1978 | Brisebarre . | |
| 4,172,462 | 10/1979 | Uchida et al. . | |
| 4,234,072 | 11/1980 | Prumm . | |
| 4,254,857 | 3/1981 | Levasseur et al. . | |
| 4,326,621 | 4/1982 | Davies . | |
| 4,353,452 | 10/1982 | Shah et al. . | |
| 4,462,513 | 7/1984 | Dean et al. | 194/100 |
| 4,474,281 | 10/1984 | Roberts et al. | 194/334 |
| 4,483,431 | 11/1984 | Pratt . | |
| 4,538,719 | 9/1985 | Gray et al. | 194/100 |
| 4,564,036 | 1/1986 | Ristvedt . | |
| 4,579,217 | 4/1986 | Rawicz-Szcerbo | 194/217 |
| 4,620,559 | 11/1986 | Childers et al. . | |
| 4,667,093 | 5/1987 | MacDonald | 250/223 |
| 4,681,128 | 7/1987 | Ristvedt et al. | 453/6 |
| 4,681,204 | 7/1987 | Zimmermann | 194/317 |
| 4,696,385 | 9/1987 | Davies | 194/319 |
| 4,715,223 | 12/1987 | Kaiser et al. | 73/163 |
| 4,731,043 | 3/1988 | Ristvedt et al. | 453/6 |
| 4,753,624 | 6/1988 | Adams et al. | 453/10 |
| 4,753,625 | 6/1988 | Okada | 453/32 |
| 4,863,414 | 9/1989 | Ristvedt et al. | 453/6 |
| 4,864,320 | 9/1989 | Munson et al. | 343/833 |
| 4,881,418 | 11/1989 | Goh et al. | 453/4 |
| 4,963,118 | 10/1990 | Gunn et al. | 453/3 |
| 4,966,570 | 10/1990 | Ristvedt et al. | 453/10 |
| 4,971,187 | 11/1990 | Furuya et al. | 194/318 |
| 4,995,497 | 2/1991 | Kai et al. | 194/318 |
| 5,002,174 | 3/1991 | Yoshihara | 194/317 |
| 5,011,455 | 4/1991 | Rasmussen | 453/10 |
| 5,021,026 | 6/1991 | Goi | 453/40 |
| 5,033,602 | 7/1991 | Saarinen et al. | 194/334 |
| 5,055,086 | 10/1991 | Ratermann et al. | 453/10 |
| 5,067,604 | 11/1991 | Metcalf | 194/203 |
| 5,090,576 | 2/1992 | Menton | 209/587 |
| 5,141,443 | 8/1992 | Rasmussen et al. | 453/10 |
| 5,194,037 | 3/1993 | Jones et al. | 453/10 |
| 5,205,780 | 4/1993 | Rasmussen | 453/10 |

(List continued on next page.)

FOREIGN PATENT DOCUMENTS

| | | | |
|---|---|---|---|
| 0149906 | 12/1984 | European Pat. Off. | G07D 3/12 |
| 0137266 | 4/1985 | European Pat. Off. . | |
| 3808159 | 9/1989 | Germany . | |
| WO 95/06920 | 8/1994 | WIPO | G07D 3/16 |

*Primary Examiner*—F. J. Bartuska
*Attorney, Agent, or Firm*—Arnold, White & Durkee

[57] ABSTRACT

A disc-type coin sorter for sorting coins of mixed diameters having improved exit slots is set forth. The sorter includes a rotatable disc having a resilient top surface and a stationary sorting head having a lower surface positioned parallel to the upper surface of the disc and spaced slightly therefrom. The lower surface of the sorting head forms a plurality of exit channels for guiding coins of different diameters to different exit stations along the periphery of the sorting head. Each of the plurality of exit channels has two side walls between which the coins are guided and a base across which the coins pass. Each exit channel has a slot in the base and the coin engages a region of the base outside of the slot.

32 Claims, 3 Drawing Sheets

U.S. PATENT DOCUMENTS 5,209,696 5/1993 Rasmussen et al. ..... 453/10
5,213,190 5/1993 Furneaux et al. ..... 194/317
5,230,653 7/1993 Shinozaki ..... 453/4
5,277,651 1/1994 Rasmussen et al. ..... 453/10
5,299,977 4/1994 Mazur et al. ..... 453/10
5,372,542 12/1994 Geib et al. ..... 453/10
5,401,211 3/1995 Geib et al. ..... 453/10
5,429,550 7/1995 Mazur et al. ..... 453/10
5,453,047 9/1995 Mazur et al. ..... 453/10
5,507,379 4/1996 Mazur et al. ..... 194/318
5,542,880 8/1996 Geib et al. ..... 453/10

DISC COIN SORTER WITH SLOTTED EXIT CHANNELS

BACKGROUND OF THE INVENTION

1. Field of the Invention

The present invention relates generally to coin sorting devices and, more particularly, to coin sorters of the type which use a resilient rotating disc and a stationary sorting head for sorting coins of mixed diameters.

2. Background Information

Although disc-type coin sorters with resilient discs have been used for a number of years, problems are still encountered in applying this technology to certain types of coin sets. Most coins depict individuals, animals, buildings or various other objects which identify a particular coin with the heritage or culture of its country. However, some of these depictions can cause the width of the coin at its center to be greater than at its periphery. An example of such a coin is an older U.S. half dollar in which various facial features of President John. F. Kennedy depicted on the coin project above the face of the coin at its periphery. If such a coin is placed on a surface, the coin will "teeter" back and forth when pressure is applied at opposing edges.

Similar problems can occur with coins that are bent. This is a common problem in countries where coins are made from softer materials. As would be expected with a bent coin, a similar type of teetering motion is encountered when pressure is placed on the edges of the coin.

The problem with the teetering motion occurs as the coin passes by an electrical or optical sensor. If teetering persists while the coin is being sensed for counting, then the coin may be counted twice due to the teetering motion. Alternatively, sensors which detect the material composition via a magnetic phenomena in an effort to discriminate good coins from counterfeit coins may mistakenly characterize a good coin as a bad coin due to the teetering motion. In summary, the teetering can cause various problems in the sensing of a coin within the coin sorting device.

In addition to the specific problem discussed above, there is also an ongoing desire for ever-greater accuracy in the sorting of coins, particularly in disc-type sorters which operate at extremely high speeds. By minimizing the surface contact between the coin and the stationary sorting head, less friction is encountered which can lead to increased speeds.

SUMMARY OF THE INVENTION

It is a primary object of this invention to provide an improved disc-type coin sorter which can be operated at extremely high speeds and with a high degree of accuracy although some coins being sorted may be bent or have a maximum thickness at the center of the coin.

In accordance with the present invention, the foregoing objective is realized by providing a disc-type coin sorter which includes a rotatable disc having a resilient top surface and a stationary sorting head having a lower surface positioned parallel to the upper surface of the disc and spaced slightly therefrom. The lower surface of said sorting head forms a plurality of exit channels for guiding coins of different diameters to different exit stations along the periphery of the sorting head. Each of the plurality of exit channels has two side walls between which the coins are guided and a base across which said coins pass. Each exit channel has a slot in the base wherein the coin guided through the exit channel engages a portion of the base in a region outside of the slot.

In one preferred embodiment, the slot has a rectangular cross-section. In another embodiment, the slot has a curved cross-section. In either embodiment, a coin having a maximum middle thickness at its center or a coin that is bent moves through the exit channel without teetering.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENTS

Figure 1:
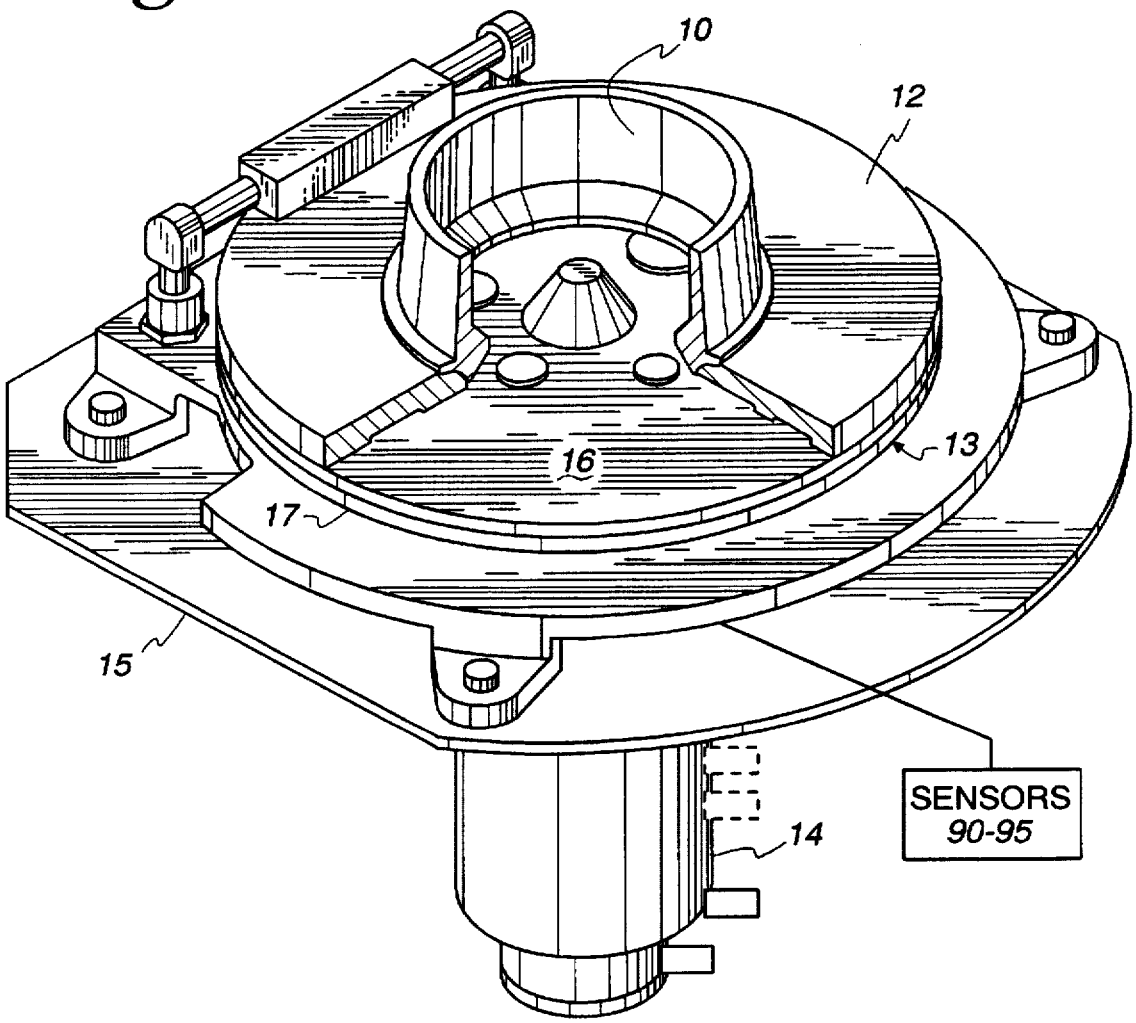
FIG. 1 is perspective view of a coin sorter embodying the present invention, with portions thereof broken away to show internal structure.

Turning now to the drawings and referring first to FIG. 1, a hopper 10 receives coins of mixed denominations and feeds them through a central feed aperture or opening in an annular sorting head or guide plate 12. As the coins pass through the central opening, they are deposited on the top surface of a rotatable disc 13. This disc 13 is mounted for rotation on a stub shaft (not shown) and driven by an electric AC or DC motor 14 attached to a mounting plate 15. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad 16 due to centrifugal and frictional forces. As the coins move outwardly, those coins which are lying flat on the pad 16 enter the gap between the pad surface and the sorting head 12 because the underside of the inner periphery of the sorting head 12 is spaced above the pad 16 by a distance which is approximately as great as the thickness of the thickest coin. As further described below, the coins are sorted into their respective denominations, and the coins for each denomination issue from a respective exit channel, such as the channels 20, 21, 22, 23, 24 and 25 of FIG. 2. The particular embodiment illustrated in FIG. 2 was specifically designed for handling six United States coins, i.e., dimes, pennies, nickels, quarters, dollars and half-dollars, respectively.

In general, the coins for any given currency are sorted by the variation in diameter for the various denominations, although in many cases it is desirable or necessary to also sort by variation in thickness. The coins circulate between the sorting head 12 and the rotating disc 13 until a single-file stream of coins is obtained. One edge of the coins in this stream of coins is aligned, and possibly adjusted, so that the other edge of the coins is subsequently gaged against gaging surfaces for directing the coins to the exit channels 20–25 for the respective denominations.

Figure 2:
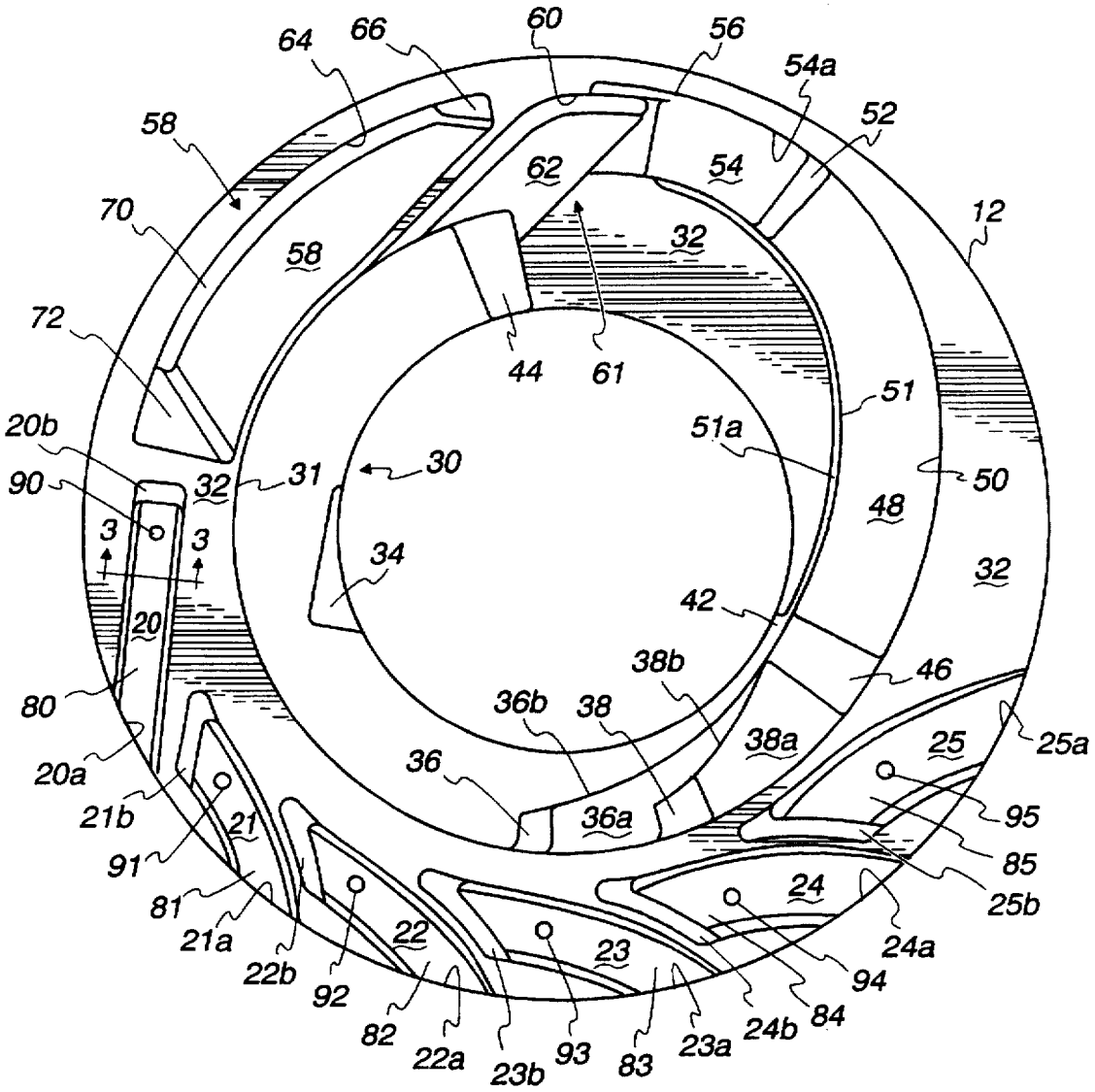
FIG. 2 is an enlarged bottom plan view of the sorting head or guide plate in the coin sorter of FIG. 1.

As can be seen most clearly in FIG. 2, the outwardly moving coins initially enter the entry channel 30 formed in the underside of the sorting head 12 from the central opening that is seen when looking into the hopper 12. It should be kept in mind that the circulation of the coins, which is clockwise in FIG. 1, appears counter-clockwise in FIG. 2 because FIG. 2 is a bottom view. A stripping notch 34 is illustrated for stripping "shingled" or "double" coins (i.e. coins which are stacked on one another). The outer wall 31 of the entry channel 30 extends downwardly to the lowermost surface 32 of the sorting head 12, which is preferably spaced from the top surface of the pad 16 by a distance which is slightly less than the thickness of the thinnest coins. Consequently, the initial outward movement of the coins is terminated when they engage the wall 31 of the entry channel 30, though the coins continue to move circumferentially along the wall 31 by the rotational movement of the pad 16.

As the disc 13 rotates, coins in the entry channel 30 that are close enough to the wall 31 engage a ramp 36 leading down to surface **36*a*. A wall 36*b* defines an inner border for the surface 36*a* and extends in an inward arc to a ramp 42 leading down to the lowermost surface 32. The wall 36*b* tends to strip "shingled" or "double" coins. Preferably, the wall 36*b* separates the top coin of a pair of "shingled" or "double" coins and guides the top coin towards the ramp 42 for recirculation. Misaligned coins that miss the ramp 36 also require recirculation. The misaligned or stripped top coins engage the wall 36*b*, and the wall 36*b* guides these coins to the ramp 42. These coins move down the ramp 42 to the lowermost surface 32, and, as the coins move down the ramp 42, the coins are pressed into the pad 16. Once in a pressed engagement with the pad 16, these coins remain in the same radial position but move circumferentially along the surface 32 until engaging recirculation ramp 44. The recirculation ramp 44 leads back up into the entry channel 30 and recirculates the misaligned or stripped coins back into the entry channel 30**.

Those coins that reach the surface **36*a* move circumferentially on the surface 36*a*, and, similarly, those coins close enough to the wall 31 engage a ramp 38 leading down to a surface 38*a*. A wall 38*b* defines the inner border of the surface 38*a* and extends in an inward arc to the ramp 42. The wall 38*b* provides another coin stripping mechanism to reduce "shingled" or "double" coins. As described above for the wall 36*b*, misaligned or stripped coins engage the wall 38*b*, and the wall 38*b* guides these coins to the ramp 42** for recirculation.

The coins that reach the surface **38*a* continue moving circumferentially along the surface 38*a* due to the rotation of the rotating disc 13 and encounter a ramp 46 leading up to a queuing channel 48. An outer wall 50 of the queuing channel 48 extends downwardly to the lowermost surface 32 of the sorting head 12. An inner wall 51 of the queuing channel 48 tends to reduce "shingled" or "double" coins within the queuing channel 48. The inner wall 51 extends downward less than the thickness of the thinnest coin to engage the top coin of "shingled" or "double" coins. For example, in the queuing channel 48, "double" or "shingled" coins are under pad pressure and tend to remain in their radial position. As such, as the "double" or "shingled" coins move circumferentially and maintain their radial position, the inner wall 51 engages the top coin of the "shingled" or "double" coins, tending to separate the coins. While the inner wall 51 separates the coins, the lower coin engages a beveled surface 51*a*, and, once separated, the lower coin is still under pad pressure with the beveled surface 51*a*. Consequently, the lower coin retains its radial position while moving circumferentially with the pad 16 and passes under the beveled surface 51*a* to the lowermost surface 32** for recirculation.

In the queuing channel 48, the coins can be pressed into engagement with the sorting head 12. This pad pressure on the coins is sometimes referred to as positive control. If the coins are free from positive control, the coins are free to move outwardly until the coins engage the wall 50 of the queuing channel 48 as the coins continue to move circumferentially due to the rotational movement of the pad 16. If the coins are under positive control, however, the coins maintain their radial position while continuing to move circumferentially along the queuing channel 48 due to the rotational movement of the pad 16.

As the coins move circumferentially along the queuing channel 48, the coins under positive control in the queuing channel 48 encounter a ramp 52 leading up into a deep channel 54. The deep channel 54 releases positive control on any thick coins that were under positive control in the queuing channel 48 and, thereby, unable to move outwardly to engage the wall 50 of the queuing channel 48. Therefore, as these coins enter the deep channel 54, the coins are permitted to move outwardly and desirably engage an outside wall **54*a* of the deep channel 54. The wall 50 of the queuing channel 48 blends into the wall 54*a* of the deep channel 54. After the coins enter the deep channel 54, the coins are desirably in a single-file stream of coins directed against the outer wall 54*a* of the deep channel 54**.

The outer wall **54*a* guides the stream of coins to a narrow ramp 56. As the coins move circumferentially along the outer wall 54*a*, the coins engage the narrow ramp 56 leading down to the lowermost surface 32 of the sorting head 12. At the terminal end of the ramp 56, the coins are firmly pressed into the pad 16. As such, the coins are under positive control. Therefore, the radial position of the coins is maintained as the coins move circumferentially towards a gaging channel 58**.

If any coins in the stream of coins leading up to the narrow ramp 56 is not sufficiently close to the wall **54*a* so as to engage the narrow ramp 56, then the misaligned coins engage an outer wall 60 of a recirculating channel 61. The recirculating channel 61 includes a beveled surface 62 that is slightly angled (e.g., 5 ¼ degrees) with respect to the pad surface. Such a beveled surface 62 allows misaligned coins to ramp away from pressed engagement with the pad 16. When the leading edges of the misaligned coins hit wall 60, the wall 60 guides the misaligned coins back to the entry channel 30** for recirculation.

It can occur that correctly aligned coins passing under the recirculating channel 61 as the coins move circumferentially towards the gaging channel 58 can be slightly shifted in their radial position. To correct this, coins which pass under the recirculating channel 61 encounter a ramp 66 leading into the gaging channel 58. The coins remain under pressure in the gaging channel 58, but the gaging channel 58 tends to urge the coins to be realigned against an outer gaging wall 64 of the gaging channel 58. The gaging channel 58 and the gaging wall 64 allow the coins in the sorting path an opportunity to realign their outer edges at the radial position required for correct sorting. To ensure that every coin engages the wall 64, the radius of the gaging wall 64 from the center of the disc is gradually decreased along the length of the gaging channel 58.

The gaging channel 58 preferably includes a beveled surface 68 that angles upward with respect to the pad surface and towards the gaging wall 64 and a deep surface 70. The coins moving into the gaging channel 58 remain under pressure from the sorting head 12, but the beveled surface 68 applies a variable amount of pressure on the coins with a greater amount of pressure on the inside edges of the coins. In this way, the beveled surface 68 helps to prevent the coins from bouncing off the wall 64 as the radial position of the coins is gradually decreased along the length of the gaging channel 58.

As the coins move along the gaging wall 64 of the gaging channel 58, the coins engage a gaging ramp 72 leading down to the lowermost surface 32. The gaging ramp 72 causes the coins to be firmly pressed into the pad 16 with their outermost edges aligned with the gaging radius provided by the gaging wall 64. At the terminal end of the gaging ramp 72, the coins are under the positive control of the sorting head 12. This ensures that the coins are held securely in the proper radial position determined by the gaging wall 64 as the coins approach the series of exit channels 20, 21, 22, 23, 24, and 25.

Beyond the gaging channel 58, the sorting head 12 forms the series of exit channels 20, 21, 22, 23, 24 and 25 which function as selecting means to discharge coins of different denominations at different circumferential locations around the periphery of the sorting head 12. Thus, the exit channels 20–25 are spaced circumferentially around the outer periphery of the sorting head 12, with the innermost edges of successive channels located progressively farther away from the common radial location of the outer edges of all coins for receiving and ejecting coins in order of increasing diameter. In the particular embodiment illustrated, the six channels 20–25 are positioned to eject successively dimes (channel 20), pennies (channel 21), nickels (channel 22), quarters (channel 23), Susan B. Anthony dollars (channel 24) and half-dollars (channel 25). The innermost edges of the exit channels 20–25 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

Typically, coin sorters operate by exerting pad pressure onto coins while those coins are within the exit channels of the coin sorter. Pad pressure is obtained because the exit channel is shallower than the thickness of the denomination corresponding to the exit channel. While in the exit channel, a coin under pad pressure is exposed to forces tending to maintain the radial position of the coin and urging the coin to move circumferentially along with the resilient pad. However, coin sorters have been designed such that the exit channel is deeper such that the coin moves freely through the exit channel while not being subjected to pad pressure. The present invention is applicable to either type of coin sorter arrangement. However, it is most useful in a coin sorter that exerts pad pressure on the coin which is more likely to cause the "teetering" effect described above.

Each exit channel 20–25 has a corresponding exit opening **20*a*–25*a* wherein the coin exits from the periphery of the sorting head 12. Although not shown, the coins then typically enter exit chutes outside the periphery of the sorting head 12 corresponding to the exit channels 20–25. Each exit channel 20–25 is also illustrated with a corresponding exit ramp 20*b*–25*b*. The exit ramp 20*b* bridges the lowermost surface 32 of the sorting head 12 with the exit channel 20 as the coin begins to enter the exit channel 20. In sorters where positive pressure is maintained, the pad 16 still maintains contact with the coin after it has passed the exit ramp 20*b*. In coin sorters which exert no pressure on the coin in the exit channel 20, the coin slowly is released from pad pressure as it moves along the exit ramp 20*b***.

Accordingly, in the present invention, each of the exit channels 20–25 has a slot 80–85 which provides additional clearance for the central portion of the coin within the exit channel 20–25. Any deviations in the central thickness of the coin due to curvature or features which extend above the periphery of the coin can now extend into the slots 80–85 such that the coin rides along the portions of the exit channels 20–25 outside of the slots 80–85. In essence, the coins ride only on the two rails formed on either side of the slots 80–85.

As the coins pass across sensors 90–95 located in the exit channels 20–25, the coins are much less prone to the teetering motion due to the slots 80–85. Thus, the sensors 90–95 sense a coin which is being guided smoothly. This enhances the accuracy of the sensors 90–95 whether their function is to count coins or discriminate between good coins and counterfeit coins.

Figure 3A:
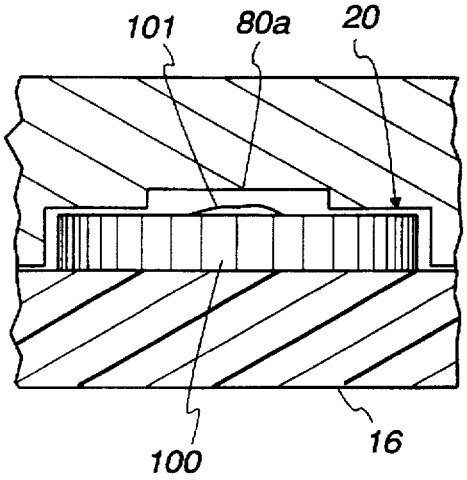
FIG. 3A is a cross-sectional view of an exit channel having a rectangular slot.

The slots 80–85 are shown in more detail in FIGS. 3A–3E which are cross sections taken along line 3—3 in FIG. 2. FIGS. 3A–3E illustrate a variety of shapes of the slot 80 which can be utilized in exit channel 20. FIG. 3A illustrates a slot **80*a* which has a length approximately one half of the diameter of coin 100. Clearly, the width of the slot 80*a* may be much larger such that it is up to 90% of the diameter of coin 100. The slot 80*a* has a rectangular cross-section which accommodates a protruding portion 101 of the coin 100 as the coin is guided along the exit slot 20. Generally, the slot 80*a* has a depth equal to approximately the thickness of the coin and is centered within the exit channel 20. The slot 80*a*** may also be configured with multiple, or stepped surfaces, such that one region of the slot is deeper than another region of the slot.

Figure 3C:
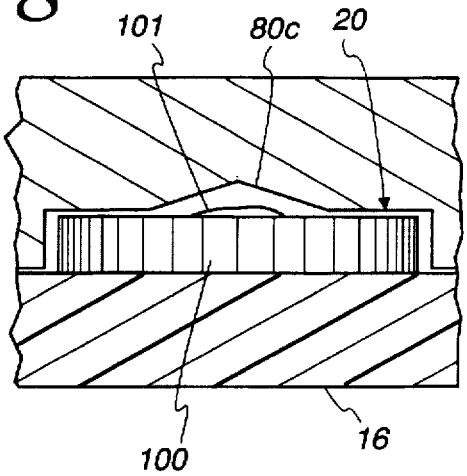
FIG. 3C is a cross-sectional view of an exit channel having a triangular slot.
Figure 3D:
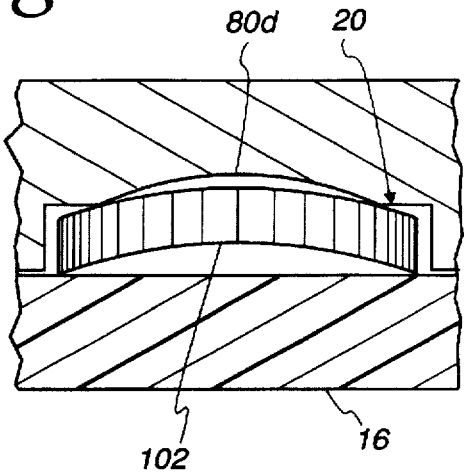
FIG. 3D is a cross-sectional view of an exit channel having an enlarged curved slot.
Figure 3B:
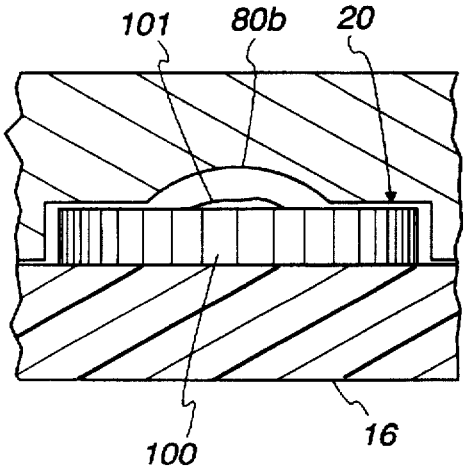
FIG. 3B is a cross-sectional view of an exit channel having a curved slot.

FIG. 3B is similar to FIG. 3A except slot **80*b* has a rounded cross-sectional shape which accommodates the protruding portion 101 of coin 100**.

FIG. 3C likewise is similar to FIG. 3A except slot **80*c* has a triangular cross-section shape which accommodates the protruding portion 101 of coin 100**.

FIG. 3D illustrates a wider slot **80*d* which is approximately 90% of the diameter of bent coin 102. The slot 80*d* has a curved cross-section profile similar to the slot 80*b* in FIG. 3B. However, due to the width of the slot 80*d*, a severely bent coin 102 can still proceed though the exit channel 20 without the bent coin 102 pressing deeply into the resilient surface 16. Because the bent coin 102 is contacting two points along the corners of the slot 80*d*, it is less likely to teeter than if only its center contacted the exit channel 20. Slot 80*d* is preferable since it allows clearance for a protruding middle portion of a coin, and also allows a bent coin 102** to pass as well.

Figure 3E:
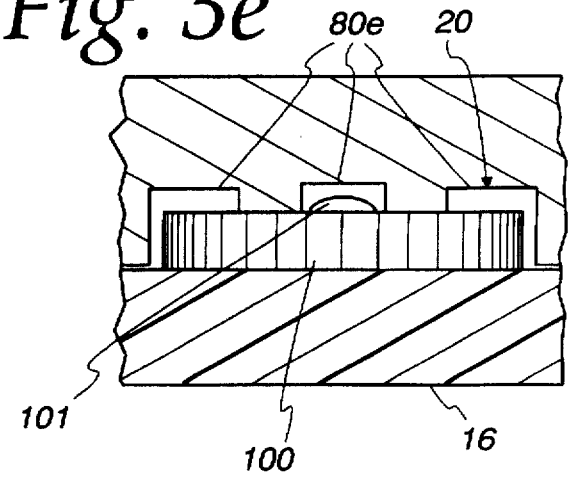
FIG. 3E is a cross-sectional view of an exit channel having multiple slots.

FIG. 3E illustrates an alternative embodiment in which three slots **80*e* are placed into the exit channel 20. The center slot provides clearance for the protruding portion 101 of the coin 100. The outer two slots provide a clearance for the periphery of a bent coin, like the bent coin 102 in FIG. 3D if that bent coin 102** is flipped upside down with respect to the manner in which it is illustrated in FIG. 3D.

The coin sorter apparatus of the present invention has been specifically described with reference to the sorting head 12. The stationary sorting head 12 of the present invention, however, can take a variety of different forms. For example, the present invention is useful in a sorting head that utilizes channels with converging walls to guide the coins to the exit channels. Slots may be used in these exit channels of such a coin sorter.

Additionally, coin sorters may have sensors which are positioned upstream of the exit channels 20–25 near beveled surface 68 on FIG. 2. A slot may be placed near sensors in this region as well to inhibit any teetering which decreases the accuracy of the counting and/or discriminating. In summary, the slots are useful anywhere a sensor may be placed.

While the invention is susceptible to various modifications and alternative forms, specific embodiments thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

We claim:

1. A disc-type coin sorter for sorting coin mixtures which include coins of mixed diameters, said sorter comprising:

a rotatable disc having a resilient top surface;

a stationary sorting head having a lower surface positioned parallel to said resilient top surface of said disc and spaced slightly therefrom;

said lower surface of said sorting head forming a plurality of exit channels for guiding coins of different diameters to different exit stations along a periphery of said sorting head, each of said plurality of exit channels having two side walls between which said coins are guided;

each of said plurality of exit channels having first, second, and third upper surfaces between and generally perpendicular to said two side walls, said first surface being adjacent to one of said two side walls and said third surface being adjacent to the other of said two side walls, said first surface being a distance D1 from said lower surface, said second surface being a distance D2 from said lower surface, and said third surface being a distance D3 from said lower surface said distance D2 being greater than said distance D1 and said distance D3; and a sensor positioned within each of said plurality of exit channels.

2. The coin sorter of claim 1, wherein said first and third surfaces are generally coplanar and said coin engages primarily said first and third surfaces.

3. The coin sorter of claim 2, wherein said second surface is planar.

4. The coin sorter of claim 2, wherein said second surface is curved.

5. The coin sorter of claim 2, wherein the difference between said distance D3 and said distance D2 and the difference between said distance D1 and said distance D2 is approximately equal to a thickness of said coin guided along said exit channel.

6. The coin sorter of claim 1, wherein said coin has a diameter and said second surface of said exit channel for said coin has a width in the range from about 50% to about 90% of said diameter of said coin.

7. The coin sorter of claim 1, wherein said resilient top surface of said rotatable disc forces said coin into engagement with at least one of said surfaces of said exit channel.

8. The coin sorter of claim 1, wherein said sensor is disposed adjacent to said second surface.

9. A disc-type coin sorter for sorting coin mixtures which include coins of mixed diameters, said sorter comprising:

a rotatable disc having a resilient top surface;

a stationary sorting head having a lower surface positioned parallel to said resilient top surface of said disc and spaced slightly therefrom;

said lower surface of said sorting head forming a coin path including a plurality of exit channels for guiding coins of different diameters to different exit stations along the periphery of the sorting head;

a slot extending lengthwise in the direction of said coin path in one of said exit channels, said one of said exit channels being defined by two generally vertical walls, said slot being located entirely within said one of said exit channels, said coin path having a first surface substantially parallel to and vertically displaced from said lower surface, said slot having a second surface substantially parallel to and vertically displaced from said first surface of said coin path, said second surface being vertically displaced from said lower surface of said sorting head by a distance greater than a distance that said first surface is vertically displaced from said lower surface of said sorting head; and a sensor disposed in said slot.

10. The coin sorter of claim 9, wherein said slot has a rectangular cross-section.

11. The coin sorter of claim 9, wherein said slot has a curved cross-section.

12. The coin sorter of claim 9, wherein said resilient top surface of said rotatable disc forces said coin into engagement with a region of one of said exit channels.

13. A disc-type coin sorter for sorting coin mixtures which include coins of mixed diameters, said sorter comprising:

a rotatable disc having a resilient top surface;

a stationary sorting head having a lower surface positioned parallel to said resilient top surface of said disc and spaced slightly therefrom;

said lower surface of said sorting head forming a coin path including a plurality of exit regions, each of said exit regions defined by two generally vertical walls, wherein coins of different diameters are guided to different ones of said plurality of exit regions, said coin path having a first surface generally parallel to and vertically displaced from said lower surface in a direction away from said rotatable disc;

a slot extending lengthwise in the direction of said coin path in said first surface of said coin path in one of said plurality of exit regions, said slot being located entirely within said exit region; and a sensor disposed in said slot.

14. The coin sorter of claim 13, wherein said slot has a rectangular cross-section.

15. The coin sorter of claim 13, wherein said slot has a curved cross-section.

16. The coin sorter of claim 13, wherein said slot has a triangular cross-section.

17. The coin sorter of claim 13, wherein said resilient top surface of said rotatable disc forces said coin into engagement with a section of one of said plurality of exit regions.

18. The coin sorter of claim 13, wherein said sensor is displaced from said first surface of said coin path.

19. The coin sorter of claim 13, wherein said coin has a diameter and said slot in said exit region corresponding to said coin has a width in the range from about 50% to about 90% of said diameter of said coin.

20. The coin sorter of claim 13, wherein said slot is centered within its corresponding exit region.

21. The coin sorter of claim 13, wherein said slot defines at least one rail.

22. A disc-type coin sorter for sorting coin mixtures which include coins of mixed diameters, the sorter comprising:

a rotatable disc having a resilient top surface;

a stationary sorting head having a lower surface positioned parallel to said resilient top surface of said disc and spaced slightly therefrom;

said lower surface of said sorting head forming a plurality of exit channels for guiding coins of different diameters to different exit stations along the periphery of said sorting head, each of said plurality of exit channels having two side walls between which said coins are guided;

sensing means disposed in at least one of said exit channels for counting said coins; and stabilizing means in each of said plurality of exit channels, said stabilizing means stabilizing bent ones of said coins and a coin having a maximum thickness at its center, said stabilizing means being in the region of said sensing means.

23. The coin sorter of claim 22, wherein said stabilizing means includes a slot in each of said plurality of exit channels.

24. The coin sorter of claim 23, wherein said slot is centered within each corresponding one of said plurality of exit channels.

25. The coin sorter of claim 23, wherein said slot defines at least one rail.

26. The coin sorter of claim 23, wherein said slot has two edges, and each of said exit channels defines a vertical plane extending therefrom, and wherein at least one of said two edges is substantially coplanar with one of said vertical planes.

27. A coin sorting system, comprising:

a coin sorter for sorting a plurality of coins of mixed denominations, said coin sorter including a coin-driving member and a stationary coin-guiding member having a coin-engaging surface opposing said coin-driving member, said coin-driving member moving said coins along said coin-engaging surface of said stationary coin-guiding member in a coin path, said coin path including a plurality of exit regions for selectively allowing exiting of said coins based upon their respective diameters;

a slot in said coin-engaging surface extending lengthwise in the direction of said coin path, said slot being positioned entirely within said coin path such that said coins simultaneously contact regions of said coin-engaging surface on both sides of said slot, said coin contacting regions on both sides of said slot being approximately coplanar, said slot being defined by at least one surface in said coin-engaging surface, said one surface being vertically displaced away from said coin-driving member; and at least one coin sensor for sensing said coins guided by said coin-guiding member, said coin sensor being disposed in said slot.

28. The coin sorting system of claim 27, wherein said coin-driving member includes a rotatable disc having a resilient surface, and said coin-guiding member includes a stationary head positioned above said rotatable disc, said plurality of exit regions including a plurality of exit channels opening at a periphery of said stationary head.

29. The coin sorting system of claim 27, wherein said coin sensors are count sensors for counting the number of said coins.

30. The coin sorting system of claim 27, wherein said coin sensors are discrimination sensors for discriminating between acceptable ones of said coins and unacceptable ones of said coins.

31. The coin sorting system of claim 27, wherein said slot is disposed in at least one of said exit regions.

32. The coin sorting system of claim 27, wherein said slot is disposed outside of said exit regions.

* * * * *